US006405390B2

(12) United States Patent
Kuen

(10) Patent No.: US 6,405,390 B2
(45) Date of Patent: Jun. 18, 2002

(54) MULTIFUNCTIONAL FOOT SPA

(75) Inventor: Yu King Kuen, Kwai Chung (HK)

(73) Assignee: Kenford Industrial Co., Ltd. (HK)

( * ) Notice: Subject to any disclaimer, the term of this patent is extended or adjusted under 35 U.S.C. 154(b) by 0 days.

(21) Appl. No.: 09/907,175

(22) Filed: Jul. 17, 2001

(30) Foreign Application Priority Data

Jul. 25, 2000 (CN) ..... 00243826

(51) Int. Cl.[7] ..... A47K 3/022

(52) U.S. Cl. ..... 4/622; 4/541.5; 601/22; 601/158

(58) Field of Search ..... 4/541.1, 541.5, 4/621, 622; 601/22, 67, 69, 70, 112, 113, 114, 158

(56) References Cited

U.S. PATENT DOCUMENTS 3,965,495 A * 6/1976 McNair ..... 4/622
5,447,491 A * 9/1995 Bellandi ..... 601/112
6,309,366 B1 * 10/2001 Maxwell ..... 601/158 X

FOREIGN PATENT DOCUMENTS

DE 2945866 * 5/1981 ..... 4/622

* cited by examiner

*Primary Examiner*—Robert M. Fetsuga
(74) *Attorney, Agent, or Firm*—Fish & Richardson P.C.

(57) ABSTRACT

The present invention provides a multifunctional foot spa comprising a chassis; a container disposed on the chassis comprising a left part and a right part; a foot rest arranged between the left part and the right part; central massage means including a massage axle and a massage accessory positioned on the foot rest; driving means comprising a plurality of motors for respectively driving the central massage means and producing hydraulic vibrations and bubbles in water filled in the container; heating means including a circuit for keeping the water at a predetermined temperature, and control means for controlling the driving means and heating means, wherein a plurality of holes and bulges are well-distributed on the base surface of the container, and a plurality of releasable and rotatable massage rollers are provided to match a plurality of recesses at the center of the base surface.

11 Claims, 6 Drawing Sheets

Fig. 13-a

| SETTING | LED LIGHT INDICATED |
|---|---|
| 0 | L1 (L5) |
| 1 | L1+L2 (L5) |
| 2 | L1+L2+L3 (L5) |
| 3 | L1+L2+L4 (L5) |
| 4 | L1+L2+L3+L4 (L5) |

Fig. 13-b

MULTIFUNCTIONAL FOOT SPA

FIELD OF THE INVENTION

The present invention relates to a foot spa, in particular, to a multifunctional foot spa capable of massaging the feet of the human in different manners such as in-water massage, vibrating massage, warm-keeping massage, mechanical massage and bubbling massage.

BACKGROUND OF THE INVENTION

Foot-treatment basins having the function of massage and foot massagers are available in the market, but each kind of them is only of a single function. For example, some foot-treatment basins have the function of heating and water circulating and some foot massagers can massage the feet with wheels or bulges positioned therein. The massage operation with these devices may be performed manually or automatically.

According to the theory of Chinese traditional medicine, there are many acupuncture points in the foot and to press these acupuncture points may improve the blood circulation in the foot which is very healthy to the whole body. Foot massage has become very popular in China over the past few years.

It is desirable for people to have the feet massaged while bathing them in water at a constant temperature. It would be ideal if some key-points of the foot can be given an extra pressing massage with vibration or massaged in the bubbled water. However, conventional foot-treatment basins and foot massagers cannot offer these functions simultaneously.

DISCLOSURE OF THE INVENTION

In view of the shortcoming in the prior art, an object of the present invention is to provide a multifunctional foot-spa to keep water at a predetermined temperature while offering strong, vibrating massage on the key acupuncture points of the foot. Some pedicure tools are also attached to the spa.

The multifunctional foot-spa according to the invention comprises a chassis; a container disposed on the chassis comprising a left part and a right part; a foot rest arranged between the left part and the right part; central massage means including a massage axle and a massage accessory positioned on the foot rest; driving means comprising a plurality of motors for respectively driving the central massage means and producing hydraulic vibrations and bubbles in water filled in the container; heating means including a circuit for keeping the water at a predetermined temperature, and control means for controlling the driving means and heating means, wherein a plurality of small holes and bulges are well-distributed on the base surface of the container, and a plurality of releasable and rotatable massage rollers are arranged to match a plurality of recesses disposed longitudinally on the base surface.

The surface of the left part and the right part are in the shape of the natural sole of the left foot and the right foot of the human; and the massage rollers raised from the surface in the height matching the bottom surface of human feet.

In the invention, the massage accessory includes an acupuncture-point massager, a foot-rubbing stone massager, a brush or a small-ball massager, and the acupuncture-point massager is preferable. All the massage accessories can be fixed to the massage axle.

The acupuncture-point massager comprises a housing comprising a plurality of openings on the upper surface thereof; a wave-shaped wheel in the housing comprising a plurality of concentric waving rings corresponding to the openings; a plurality of round steel rods arranged on the waving rings and extended upwards through the openings; and a clutch arranged in the bottom part of the housing and engaged with the wave-shaped wheel. The number of the steel rods in each waving ring increases from the inside to the outside and the steel rod has a hemisphere upper surface. The wave ring has a wave-like upper surface associated with the bottom part of the steel rods, and the motor drives the wave-shaped wheel through the clutch so that the steel rods move up and down. In one preferred embodiment of the invention, the steel rod has a hemisphere bottom surface with a stopper close thereto.

In one preferred embodiment of the invention, the foot spa may further comprise an accessory cabinet arranged at the upper part of the container, which includes a cover and one or more plugs for fixing the massage accessory.

In another embodiment of the invention, the foot spa may further comprise control means including a switch for controlling the motors and heating means respectively, or, any combination of them.

In another embodiment of the invention, the foot spa may further comprise a water-wiping plate adhered to the edge of the accessory cabinet.

In the invention, the massage roller may be varied in shape and matched with the recesses on the base surface of the container. In general, the massage roller may be in the shape of a long waist drum with a plurality of bulges along the circumference of the roller surface. One embodiment of the massage roller in the invention has axial bulges well-distributed along the circumference of the roller surface, between two axial bulges are positioned two axial hollow grooves on the left half and on the right half respectively, and the middle part of the roller is hollow.

BRIEF DESCRIPTION OF THE DRAWINGS

FIGS. 13-*a* and 13-*b* show different functions of a foot spa according to the invention controlled by FIG. 13.

BEST MODE OF CARRYING OUT THE INVENTION

The present invention will be further described in conjunction with the accompanying drawings.

Figure 1:
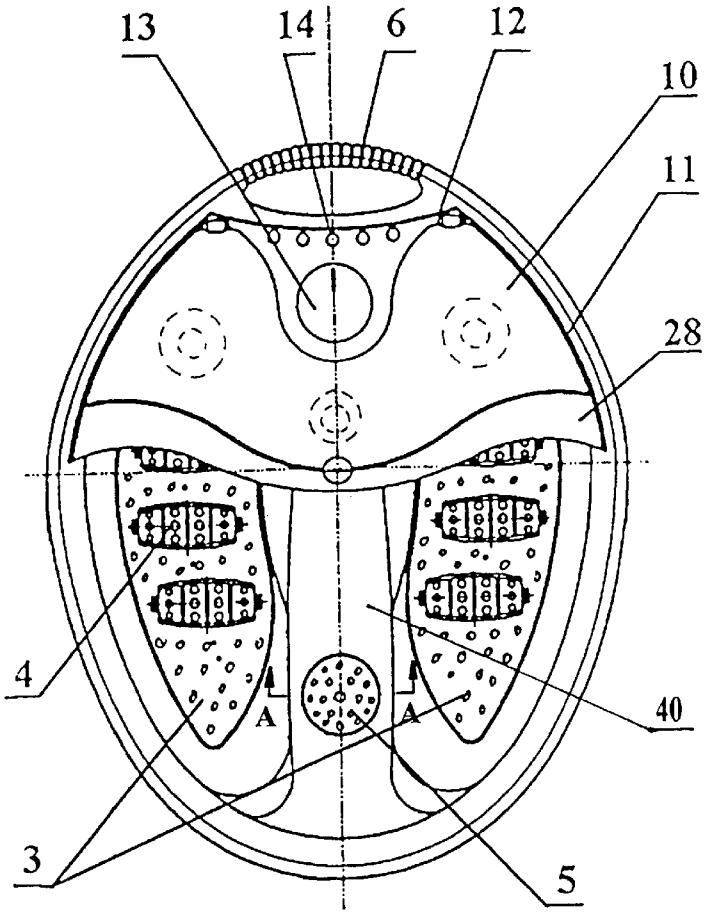
FIG. 1 is a top view of a multifunctional foot-spa according to one preferred embodiment of the present invention.
Figure 2:
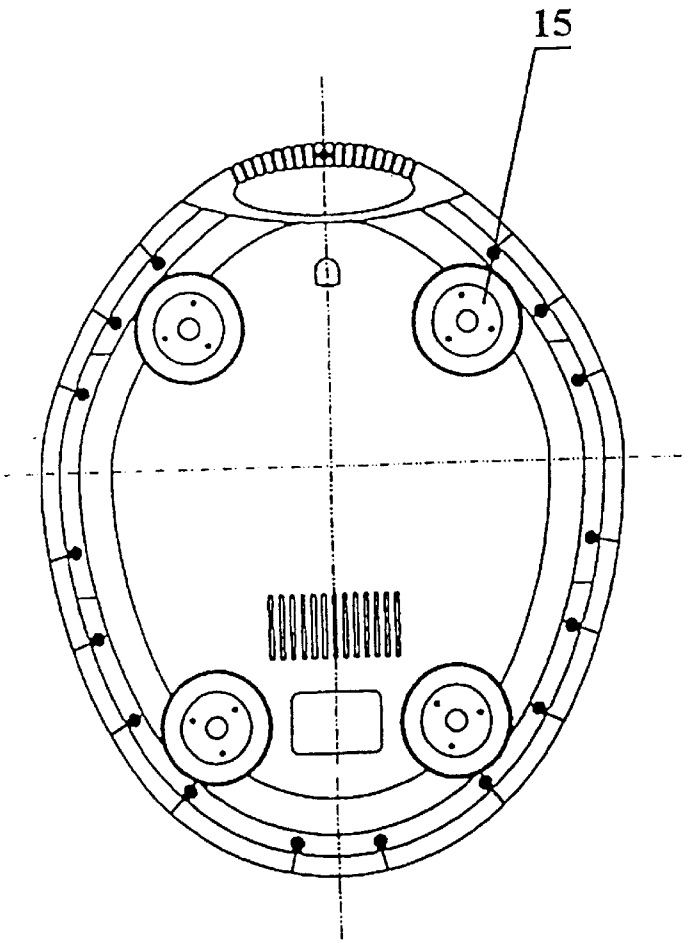
FIG. 2 is a back view of the multifunctional foot-spa shown in FIG. 1.
Figure 3:
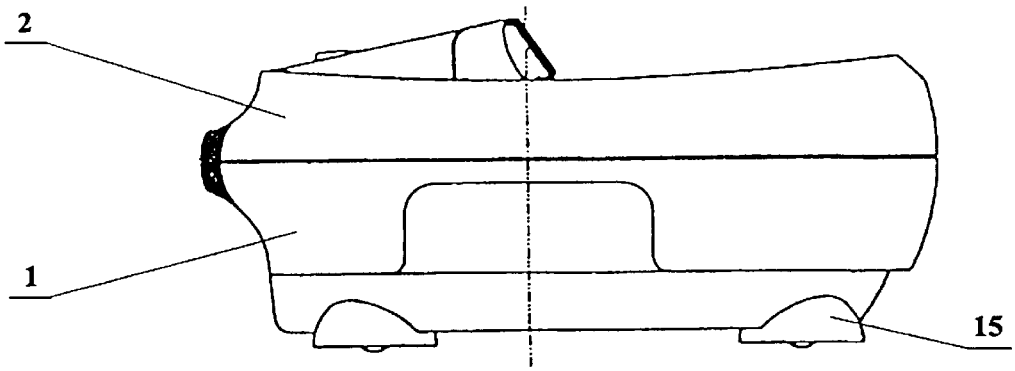
FIG. 3 is a left side view of the multifunctional foot-spa shown in FIG. 1.

FIGS. 1–8 and FIG. 10 show one embodiment of the invention. As shown in FIGS. 1–3, a multifunctional foot spa of the invention comprises a chassis 1, a container 2 positioned on the chassis 1. Driving means including motors 17, 18, and 19 is disposed between the chassis 1 and the container 2. Four supports 15 may be fixed on the bottom of the chassis for supporting the foot spa. As shown in FIG. 1, the container 2 comprises a left part and a right part, each having a baseboard 3 on which a plurality of small holes and bulges are well-distributed. Three recesses are formed on the surface of the baseboard to match three massage rollers 4 which are rotatable in the recesses and detachable from the same. The three massage rollers in the three recesses are arranged above the surface of the baseboard to match the foot sole. A foot rest 40 is formed between the left part and the right part. Center massage means includes a massage axle 52 disposed on the foot rest close to the rear edge of the container and a massage accessory 5 engaged with the axle 52. A cabinet 10 with a cover 11 for containing the massage accessory 5 and other accessories is arranged on the front portion of the foot spa. The cover 11 may be opened and linked with the container by hinges 12 in this embodiment. A water-wiping plate 28 for wiping off water from the feet is adhered to one edge of the cabinet 10. Control means including a control button 13 and a display 14 for displaying current working conditions is positioned on the top of the cabinet 10. A handle 6 is integrally formed at the linkage between the container 2 and the chassis 1.

Figure 4:
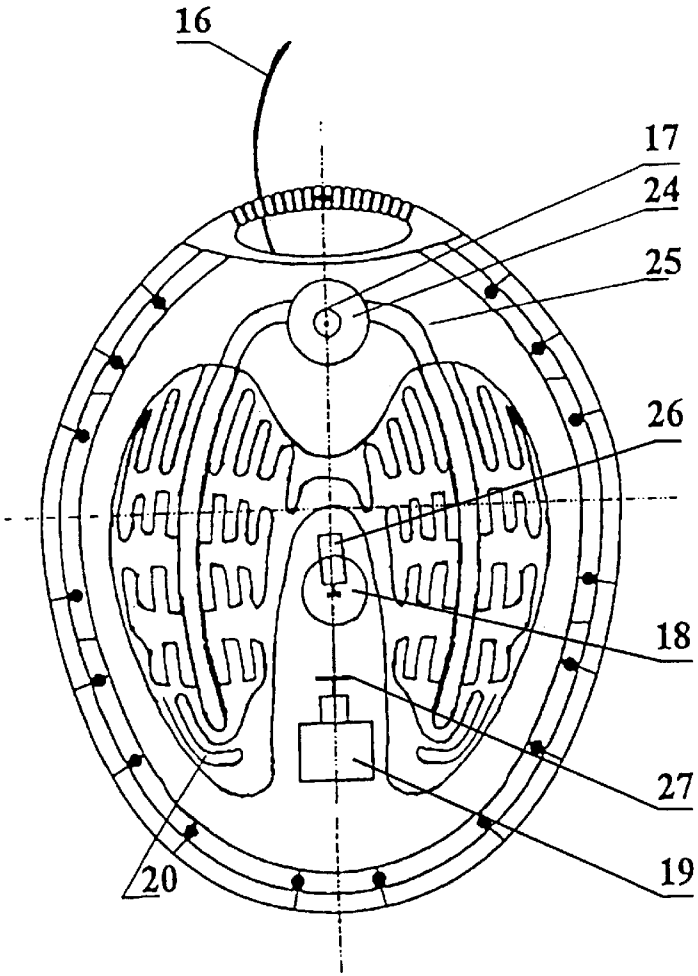
FIG. 4 is a back view of the multifunctional foot-spa without a chassis shown in FIG. 1.

FIG. 4 shows that a power supply wire 16, a first motor 17, a second motor 18, a third motor 19, and a circuit 20 between the chassis and the container. The circuit 20 comprises a lot of resistance wires that are embedded into the baseboard for heating water in the container.

Figure 5:
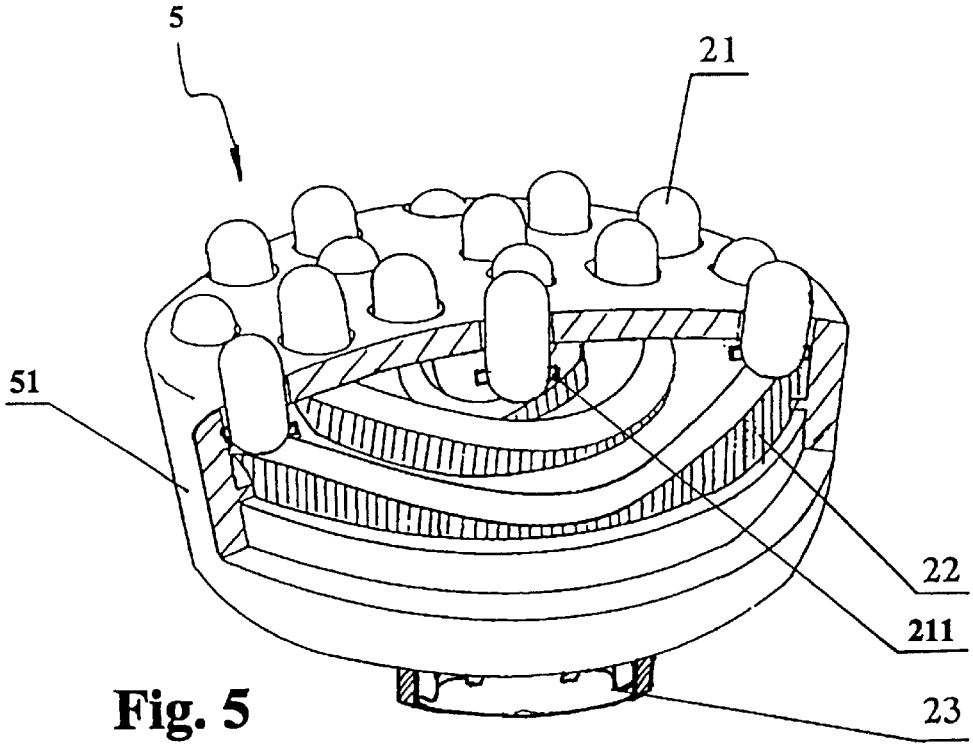
FIG. 5 is a perspective diagram of an acupuncture-point massager adapted in the multifunction foot-spa shown in FIG. 1.

FIG. 5 shows a kind of the massage accessory 5, an acupuncture-point massager, adapted in the invention, which can be fixed on the massage axle 52. The acupuncture-point massager comprises a housing 51 in the shape of the head of a torch, a clutch 23 positioned in the bottom of the acupuncture-point massager, a wave-shaped wheel 22 associated with the clutch 23 comprising three concentric waving rings, each of which has a wave-like surface, and a plurality of steel rods 21 standing on the concentric waving rings. The housing includes a plurality of openings on the upper surface thereof. Each opening corresponds to a steel rod and allows the steel rod to move up and down through the opening. In this embodiment, both ends of the steel rod are in the shape of a hemisphere and a stopper 211 is formed close to the lower end of the steel rod. The number of the steel rods in each waving ring increases from the inside to the outside. When the acupuncture-point massager is fixed to the axle, the motor 19 drives the wave-shaped wheel to rotate through the clutch. The steel rod moves upwards when the lower end of the rod is in the wavecrest of the waving ring and moves downwards when the lower end of the rod is in the wave trough of the waving ring. The clutch 23 represents a connection between the wheel 22 and the motor 19. Those skilled in the art may appreciate other connection manners can be used in the invention.

Figure 9:
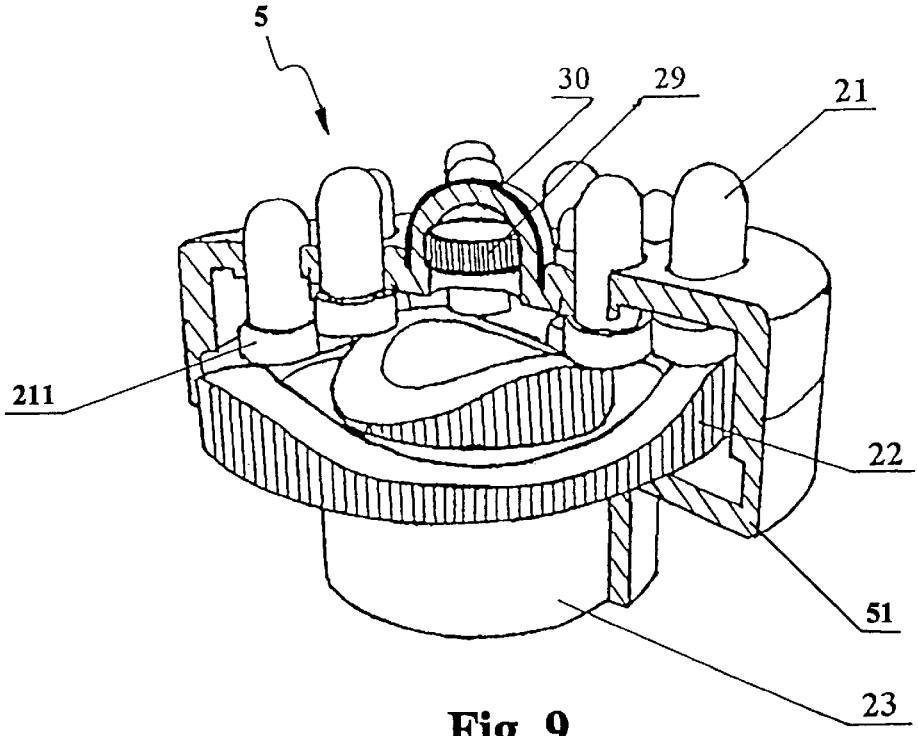
FIG. 9 is a perspective diagram of another acupuncture-point massager according to the present invention.

FIG. 9 illustrates another embodiment of the acupuncture-point massager of this invention. There are two waving rings 22 in the massager. At the center of the housing is formed a bigger hemispherical bulge 30, which contains a magnet 29. Around the bulge, two circles of the steel rods 21 (6 in the inner circle and 12 in the outer circle) are distributed. In this embodiment, the lower end of the steel rod with the stopper 211 matches the waving ring.

Figure 6:
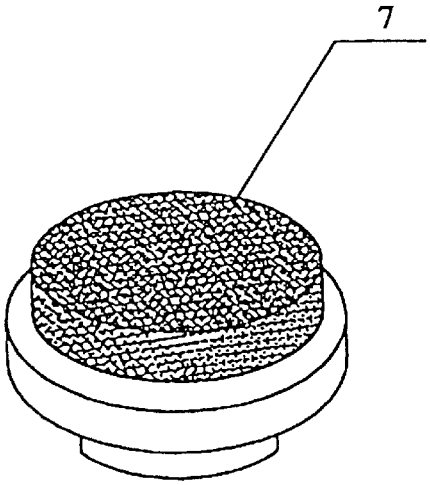
FIG. 6 is a perspective diagram of a foot-rubbing stone adapted in the multifunctional foot-spa shown in FIG. 1.
Figure 7:
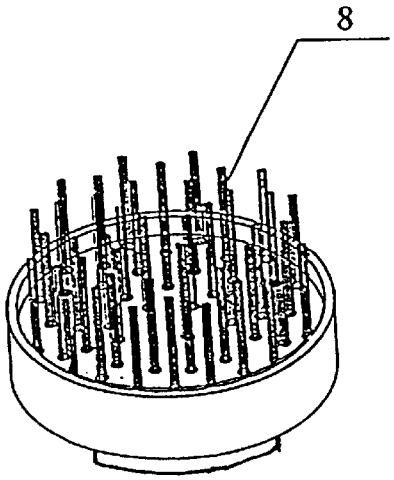
FIG. 7 is a perspective diagram of a foot-brushing massager adapted in the multifunctional foot-spa shown in FIG. 1.
Figure 8:
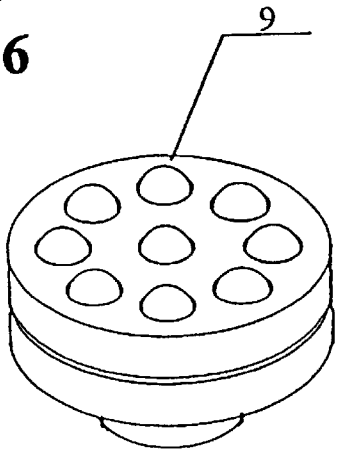
FIG. 8 is a perspective diagram of a ball-massager adapted in the multifunctional foot-spa shown in FIG. 1.

FIGS. 6–8 shows other massage accessories used in the invention, a foot-rubbing stone 7, a brush 8, and a ball-massager 9. All these accessories have the same clutch as the massage accessories indicated above so that they can be mounted on the massage axle 52 alternatively for massage and pedicure of the feet. When the accessories are not in use, they can be fixed to plugs positioned in the accessory cabinet 10.

Figure 10:
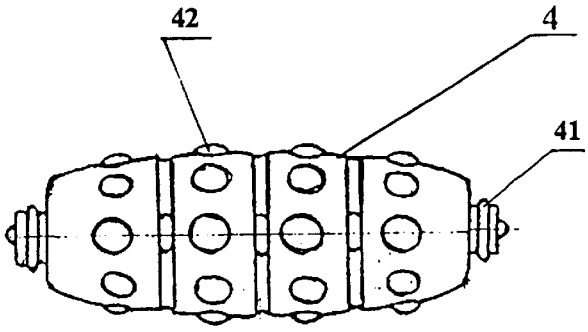
FIG. 10 shows schematically a massage roller of the invention.
Figure 11:
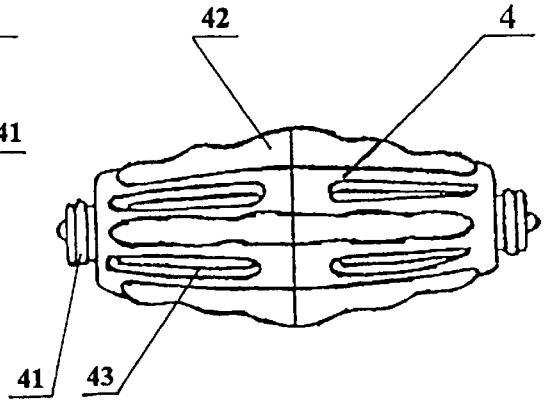
FIG. 11 shows schematically another massage roller according to the present invention.
Figure 12:
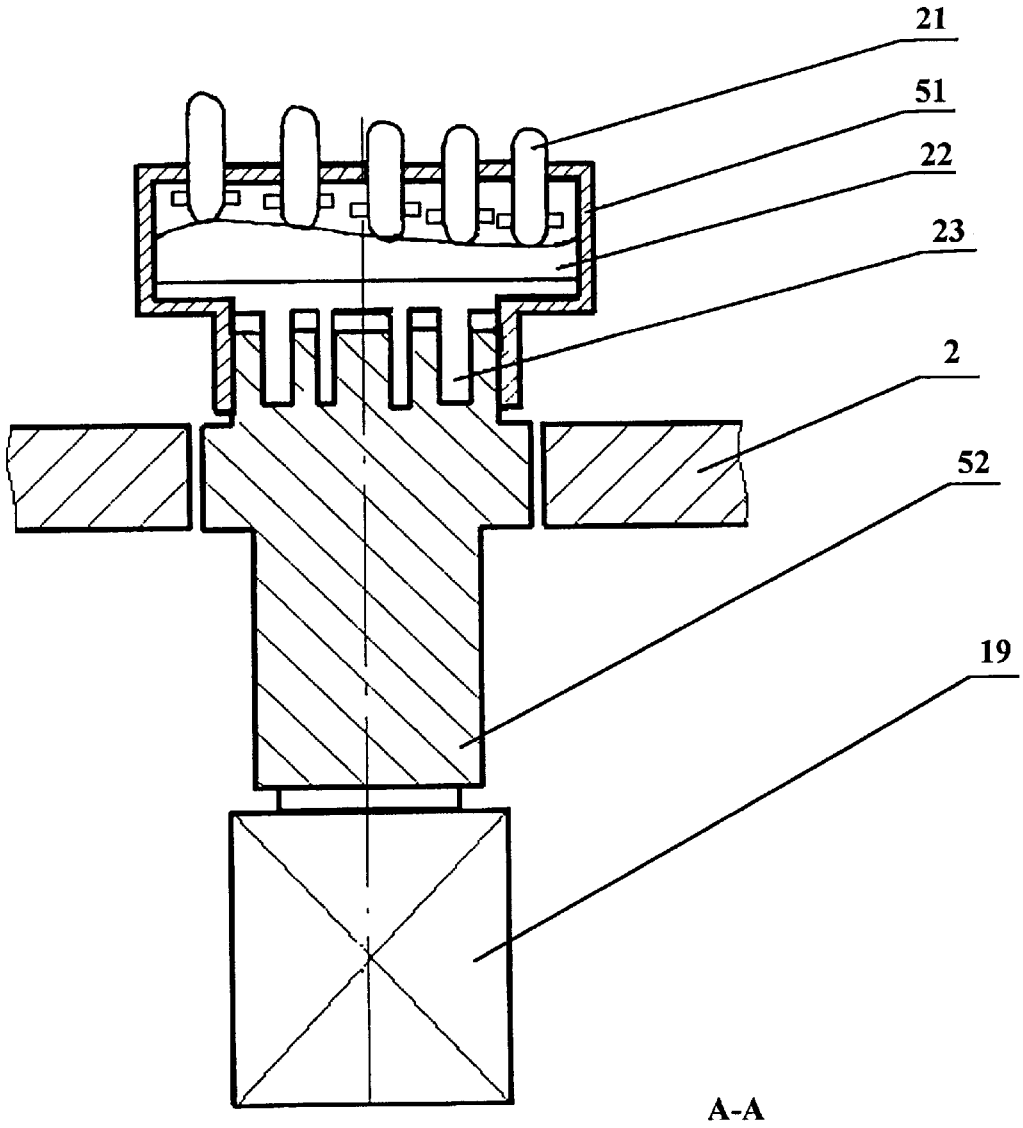
FIG. 12 is a sectional view along with line A—A in FIG. 1.

FIGS. 10 and 11 respectively exemplify the massage roller 4 adapted for the invention. The massage rollers 4 are generally in the shape of a long waist drum. A plurality of small bulges are formed on the roller surface. A bearing 41 is provided at each end of the roller so that, when the roller is disposed in the recess of the baseboard, it can be rotated axially.

Figure 13:
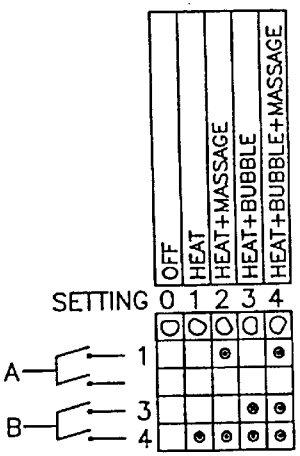
FIG. 13 shows a circuit used in the present invention.
Figure 13:
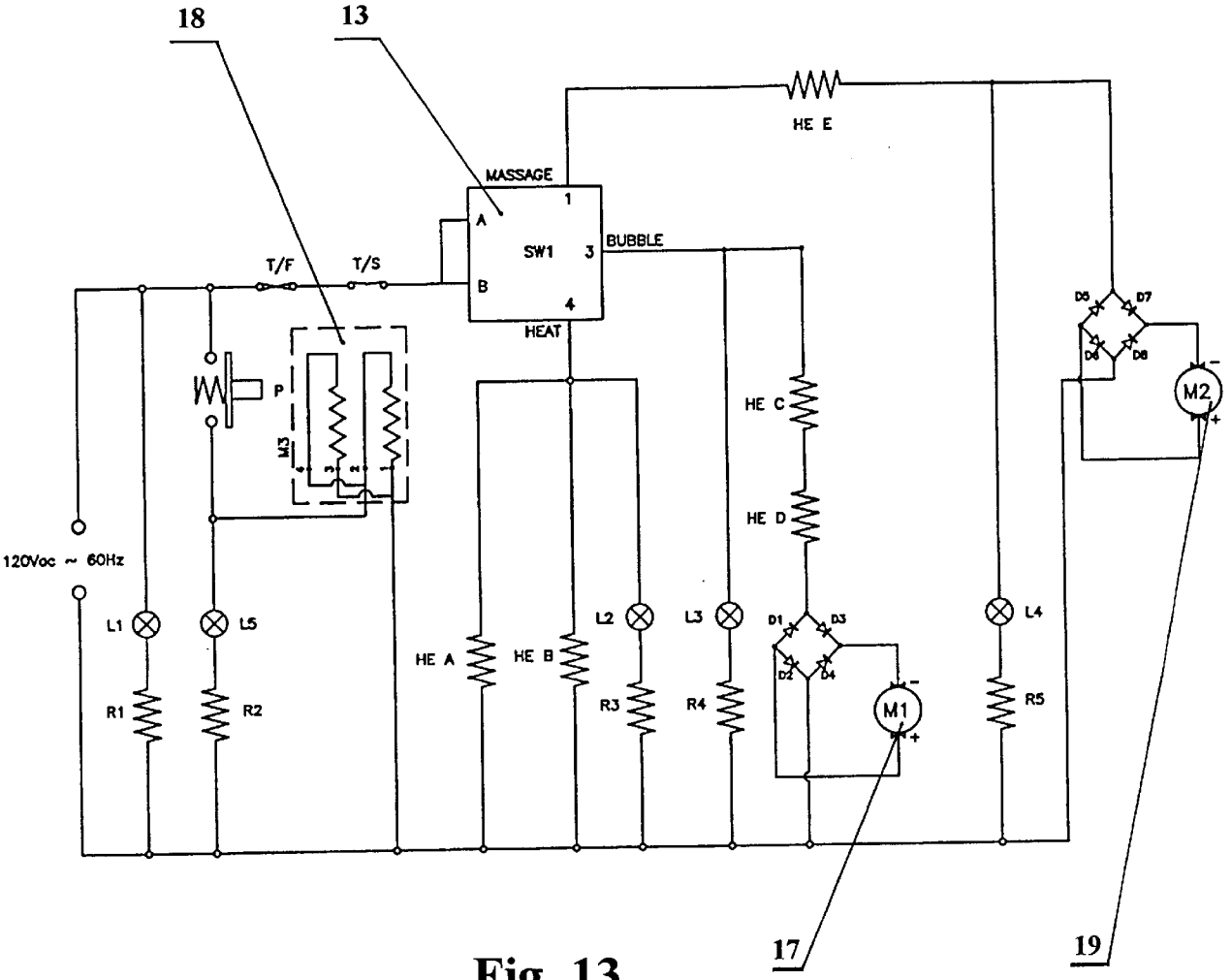

Referring to FIGS. 4 and 13, the motor 17 is used to generate bubbles and/or waves in water by driving an air pump 24 which is connected to the holes on the baseboard, the motor 18 is used to generate vibrations, and the motor 19 drives the massage axle on the foot rest. Reference numeral 27 represents a fan driven by the motor 19 for keeping the device at an appropriate temperature.

The control means comprises the button 13 for controlling various functions of the foot spa respectively or in combined way, which is obvious for those skilled in the art. As shown in FIGS. 13-*a* and 13-*b*, the foot spa according to the invention can work with varied functions upon the user requirement. For instance, the user may operate the motor 17 for generating the bubbles, while turning on the circuit 20 for heating water. Namely, the users can choose any of such effects as "heating plus warm-keeping", "heating, warm-keeping plus vibration", "heating, warm-keeping plus bubbling" "heating, warm-keeping, vibration plus bubbling". Varied massage accessories can be fixed to the massage axle for massaging the foot in view of the user's need.

According to the invention, people can use the massage roller 4 on the baseboard 3 to massage those key acupuncture points on the arch and the heel of the sole, can use the acupuncture-point massager 5 to enjoy a strong massage, and can bathe the feet in warm water. The air pump 24 injects compressed air into the water inside the container 2 to generate bubbles. An eccentric balance weight 26 is driven to vibrate the water in the container. People may also use the foot-rubbing stone 7, the brush 8 and the ball massager 9 to treat the feet.

A water-wiping plate 28 made of flexible materials is provided to wipe off extra water drops on the feet easily.

While enjoying the comfortable foot massage, people may also adjust the functions and intensity to meet practical needs and use convenient accessories to massage the feet and pedicure. The multifunctional foot-spa according to the invention is an ideal product for the health care of the feet.

What is claimed is:

1. A multifunctional foot spa comprising a chassis;

a container disposed on the chassis comprising a left part and a right part;

a foot rest arranged between the left part and right part;

central massage means including a massage axle and a massage accessory positioned in the foot rest;

driving means comprising a plurality of motors for respectively driving the central massage means and producing vibrations and bubbles when water is filled in the container;

heating means including a circuit for keeping water in the container at a predetermined temperature;

control means for controlling the driving means and heating means; and wherein a plurality of holes and bulges are well-distributed on the baseboard of said container, and a plurality of releasable and rotatable massage rollers are provided to match a plurality of recesses formed longitudinally on the surface of the left part and the right part.

2. The foot-spa as claimed in claim 1, wherein the surface of the left part and the right part is in the shape of a natural sole of the left foot and the right foot of the human, respectively; and said massage rollers bulging out of said base surface in the height match the bottom surface of the human foot.

3. The foot-spa as claimed in claim 1, wherein said massage accessory includes an acupuncture-point massager, a foot-rubbing stone massager, a brush massager or a small-ball massager.

4. The foot spa as claimed in claim 3, wherein the acupuncture-point massager comprises:

a housing in the shape of the head of a torch comprising a plurality of openings on the upper surface thereof;

a wave-shaped wheel in the housing comprising a plurality of concentric waving rings corresponding to said openings;

a plurality of round steel rods arranged on said waving rings and extended upwards through said openings; and a clutch arranged in the bottom part of the housing and connected to said wave-shaped wheel, wherein the number of the steel rods in each waving ring increases from the inside to the outside, said steel rod has a hemisphere upper surface, said wave ring has a wave-like upper surface associated with the bottom part of the steel rods, and said motor drives said wave-shaped wheel through the clutch so that the steel rods move up and down.

5. The foot-spa as claimed in claim 4, wherein a bottom part of said steel rod comprises a stopper.

6. The foot-spa as claimed in claim 1 wherein said foot-spa further comprises an accessory cabinet arranged in the upper part of the container, which includes a cover and one or more plugs for fixing said massage accessory.

7. The foot-spa as claimed in claim 1, wherein said foot spa further comprises control means including a switch for controlling said motors and heating means respectively, or, any combination of them.

8. The foot spa as claimed as claim 1 further comprising a water-wiping plate adhered to the edge of the accessory cabinet.

9. The foot-spa as claimed in claim 1, wherein each of said massage rollers is in the shape of a long waist drum with a plurality of bulges along the circumference of the roller surface.

10. The foot-spa as claimed in claim 1, wherein each of said massage rollers is in the shape of a long waist drum and has axial bulges well-distributed along the circumference of the roller surface, wherein between two axial bulges are positioned two axial hollow grooves on the left half and on the right half respectively, and the middle part of said roller is hollow.

11. The foot-spa as claimed in claim 1 further comprising a handle integrally formed at the linkage between the chassis and the container at the front side of the foot spa.

* * * * *